US007416770B2

(12) United States Patent
Hiorth

(10) Patent No.: US 7,416,770 B2
(45) Date of Patent: Aug. 26, 2008

(54) REINFORCEMENT RING

(75) Inventor: Espen Hiorth, Trondheim (NO)

(73) Assignee: Bronnteknologiutvikling AS, Trondheim (NO)

( * ) Notice: Subject to any disclaimer, the term of this patent is extended or adjusted under 35 U.S.C. 154(b) by 290 days.

(21) Appl. No.: 11/260,039

(22) Filed: Oct. 25, 2005

(65) Prior Publication Data

US 2006/0290066 A1 Dec. 28, 2006

(30) Foreign Application Priority Data

Jun. 28, 2005 (NO) ..... 20053147

(51) Int. Cl.
*E21B 33/012* (2006.01)

(52) U.S. Cl. ..... 428/66.4; 267/1.5; 267/167; 277/322

(58) Field of Classification Search ..... 428/66.4; 267/1.5, 167; 277/322
See application file for complete search history.

(56) References Cited

U.S. PATENT DOCUMENTS 4,509,763 A 4/1985 Fischer
2002/0043368 A1 4/2002 Bell et al.

FOREIGN PATENT DOCUMENTS

GB 2 291 086 1/1996

OTHER PUBLICATIONS

Norwegian Search Report, dated Jan. 16, 2006.

*Primary Examiner*—Alexander Thomas
(74) *Attorney, Agent, or Firm*—Alix, Yale & Ristas, LLP

(57) ABSTRACT

A reinforcement ring, includes an annular coil spring with a core unit arranged inside to prevent deforming or twisting of the ring under load. The core unit is formed from a chain of interlinked elements, each having a male part and a female part; the male parts of each element being engaged with corresponding female parts of an adjoining element.

7 Claims, 3 Drawing Sheets

REINFORCEMENT RING

FIELD OF THE INVENTION

The invention relates to a reinforcement ring, particularly for confining elastomeric sealing or packer elements in a well plug.

BACKGROUND OF THE INVENTION

Reinforcement rings are used for various purposes in packer elements, particularly to withstand high pressure and high temperatures. One common usage is to confine elastomeric packer or sealing elements in well bore plugs.

Prior art reinforcement rings have been designed with two or more annular coil springs arranged concentric. Such elements have been liable to deform under high pressure, e.g.; the pressure existing at the ends of elastomeric sealing rings under high compacting pressure or at similar straining applications.

An object of the invention is to provide a reinforcement ring enduring the stresses of heavy loads or pressures. Particularly, it is an object to provide a reinforcement ring withstanding the deforming forces acting at the high pressures of a well bore plug or similar uses, to maintain its circular cross section and thus stay operable.

SUMMARY OF THE INVENTION

Reinforcement rings according to the invention have proved to be rigid at the practical operating pressures of a well bore plug.

A reinforcement ring, includes an annular coil spring with a core unit arranged inside to prevent deforming or twisting of the ring under load. The core unit is formed from a chain of interlinked elements, each having a male part and a female part; the male parts of each element being engaged with corresponding female parts of an adjoining element.

More details will appear in the following description of an example of an embodiment of the invention.

BRIEF DESCRIPTION OF THE DRAWINGS

The invention will be described with reference to the drawings, in which.

DETAILED DESCRIPTION OF THE PREFERRED EMBODIMENT

Figure 1:
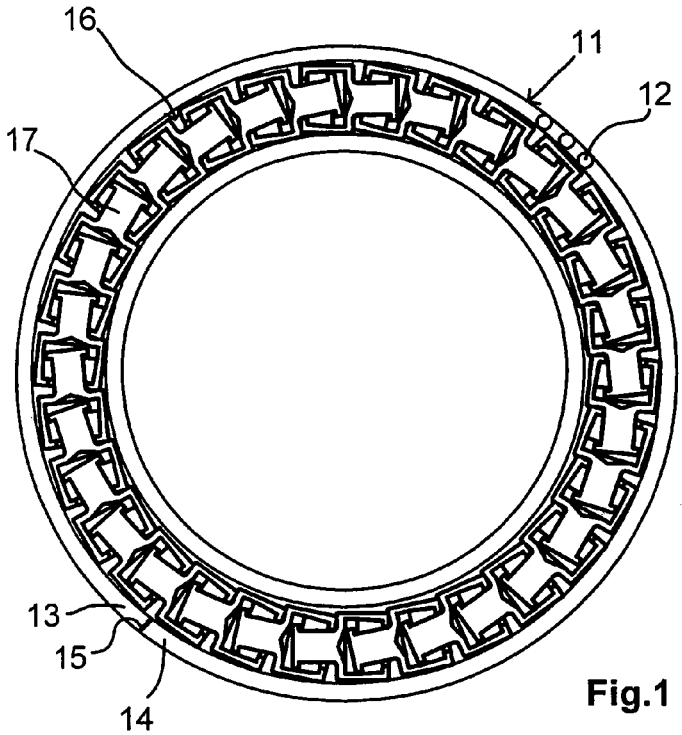
FIG. 1 shows a planar section perpendicular to the axis of an embodiment of a reinforcement ring according to the invention, in its compressed position.

FIG. 1 shows a reinforcement ring 11 comprising an annular coil spring 12. The ends 13 and 14 of the coil spring 12 are joined before completion by soldering or gluing 15, as will be described below.

In the coil spring 12 a core unit 16 comprising a chain of core elements 17, are arranged, in the example 44 elements. The structure of the core elements 17 will be described in more detail with reference to FIGS. 5 and 6.

Figure 2:
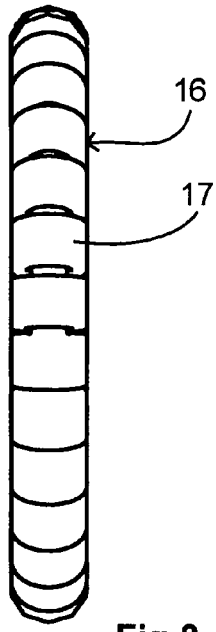
FIG. 2 shows a side view of the core unit of the reinforcement ring of FIG. 1.

FIG. 2 shows the core unit 16 in its compressed form as used in the reinforcement ring in FIG. 1. Due to the function to be described below, the core elements 17 can be moved between a compressed position close to the adjoining core elements and an expanded position with a larger mutual distance.

Figure 3:
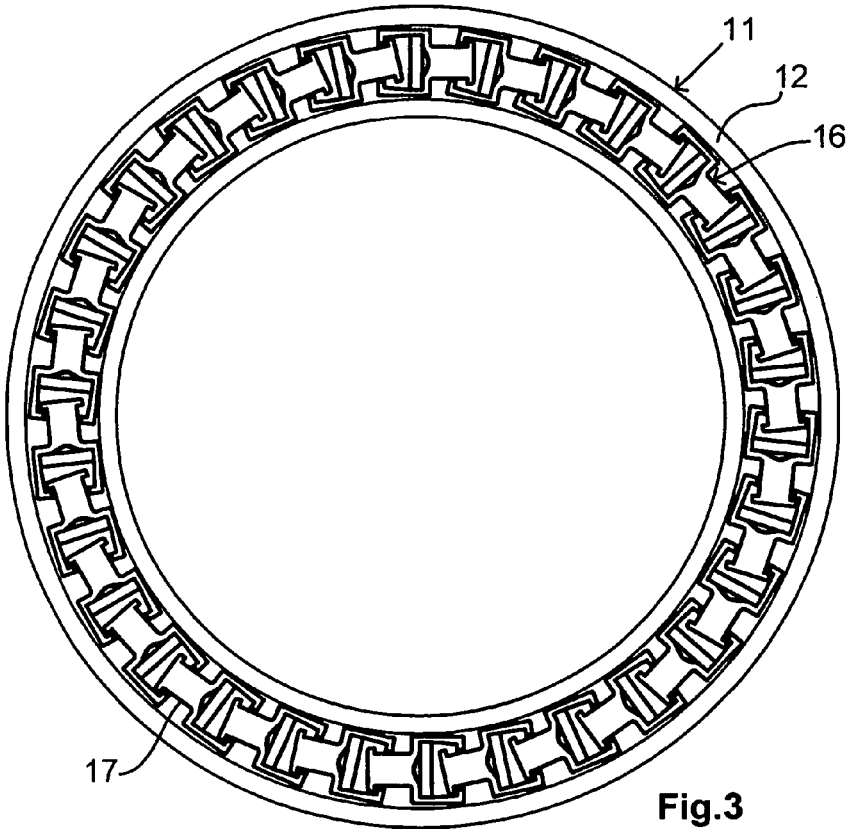
FIG. 3 shows a view corresponding to FIG. 1 of the reinforcement ring in its expanded position.
Figure 4:
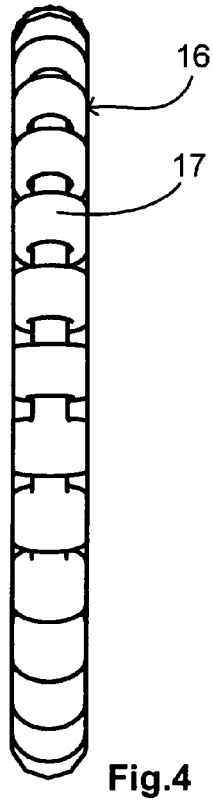
FIG. 4 shows a side view of the core unit in its expanded position.

FIGS. 3 and 4 show the reinforcement ring 11 and the core unit 16 in its expanded position.

Figure 5:
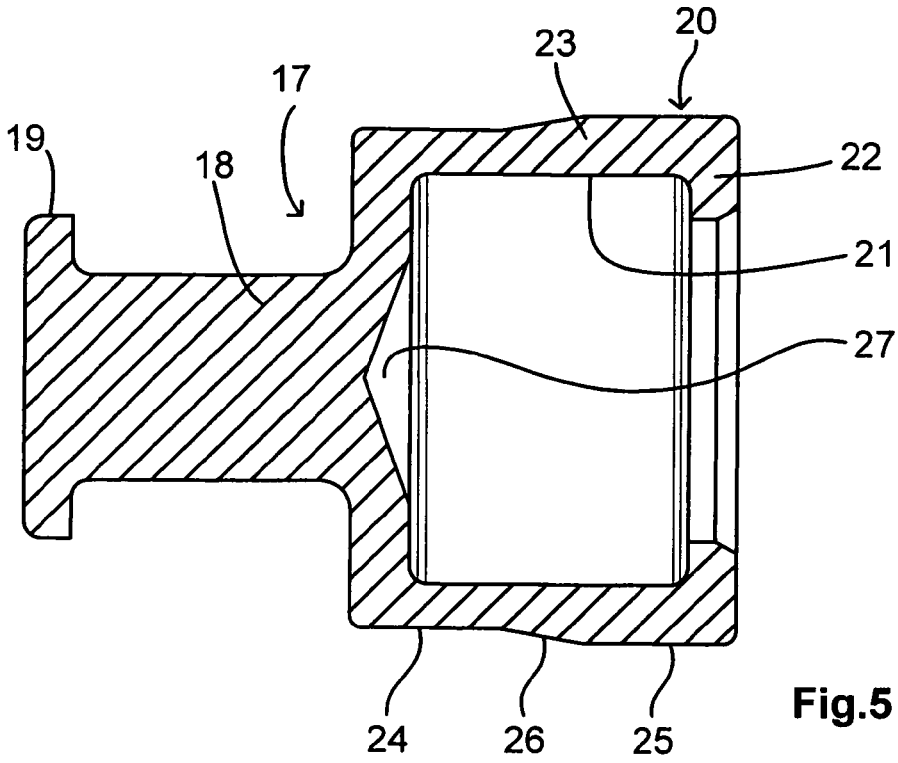
FIG. 5 shows an axial cross section of a core unit prior to its mounting.

FIG. 5 shows a core element 17 in its pre-mounting form. The element 17 has a cylindrical shank 18 with a radial flange 19 at one end, and a cylindrical cup 20 at the other end, like a stemmed glass. The cylindrical cup 20 has a cylindrical void 21 with a radial end flange 22 protruding into the opening of the cup 20 with a free diameter allowing the entrance of a flange 19.

The external wall 23 of the cylindrical cup 20 has smaller bottom diameter at 24 merging into a greater upper diameter at 25 with a bevelled transition zone 26. The difference of said two diameters may be approximately 0.5 mm. The bottom of the cylindrical cup 20 has a central bevelled recess 27.

Figure 6:
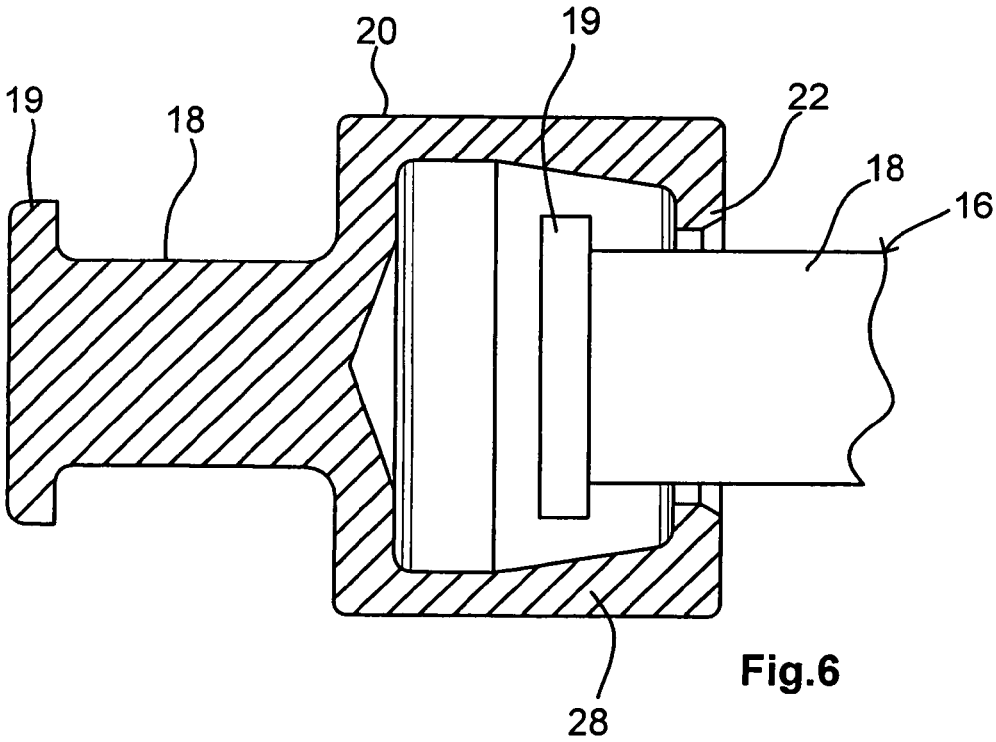
FIG. 6 shows the core element of FIG. 5 after compression for mounting, the adjoining elements being omitted for sake of simplicity.

Core elements 17 according to FIG. 5 may be chained to a core unit 16 by entering the flange 19 of one core element 17 into the cylindrical cup 20 of an adjoining core element 17. After this assembly, the core elements are pressed through a die with a diameter of the opening equal to the external diameter of the bottom part 24 of the cylindrical cup. This will compress the upper, enlarged part 25 of the cylindrical cup 20 to the smaller diameter as shown in FIG. 6, leaving an upper bevelled restriction part 28 on the internal side of the cylindrical cup 20 and restricting the opening diameter of the annular end flange 22 to a size slightly, e.g. 0.5 mm, less than the diameter of the flange 19, inhibiting the opening of the chained core unit 16.

Figure 8:
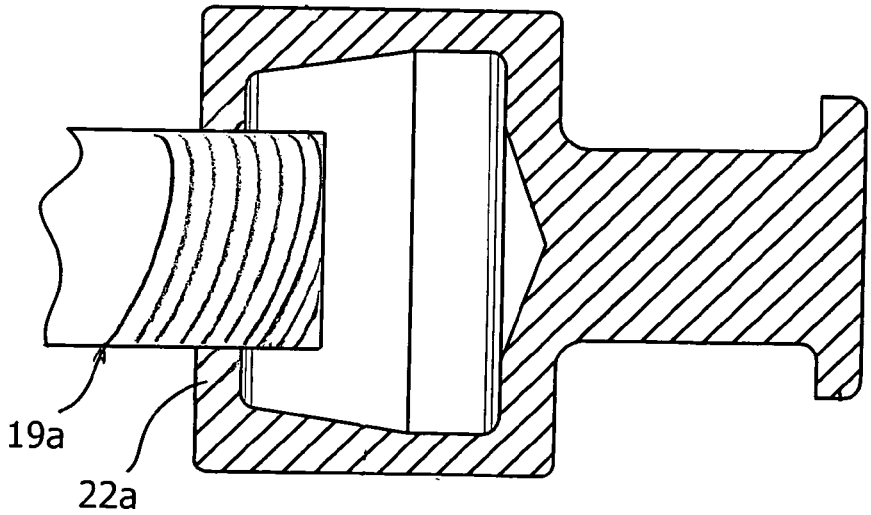
FIG. 8 shows a mating threads to close the annular chain.

To close the chain unit 16 to the annular form shown, one external flange 19*a* and its adjoining internal flange 22*a* are threaded, to allow the final assembly by screwing these elements together, as shown in FIG. 8.

The external diameter of the cylindrical cups 20 are dimensioned to fit into the annular coil 12.

The reinforcement ring 11 according to the invention is primarily intended to serve as a back up element on each end of an elastic, e.g. elastomeric or rubber packer element of a well bore plug, to prevent the extrusion of parts of the packer element into the annular space between the plug and the wall of the tubing. It may also serve other similar purposes.

Figure 7:
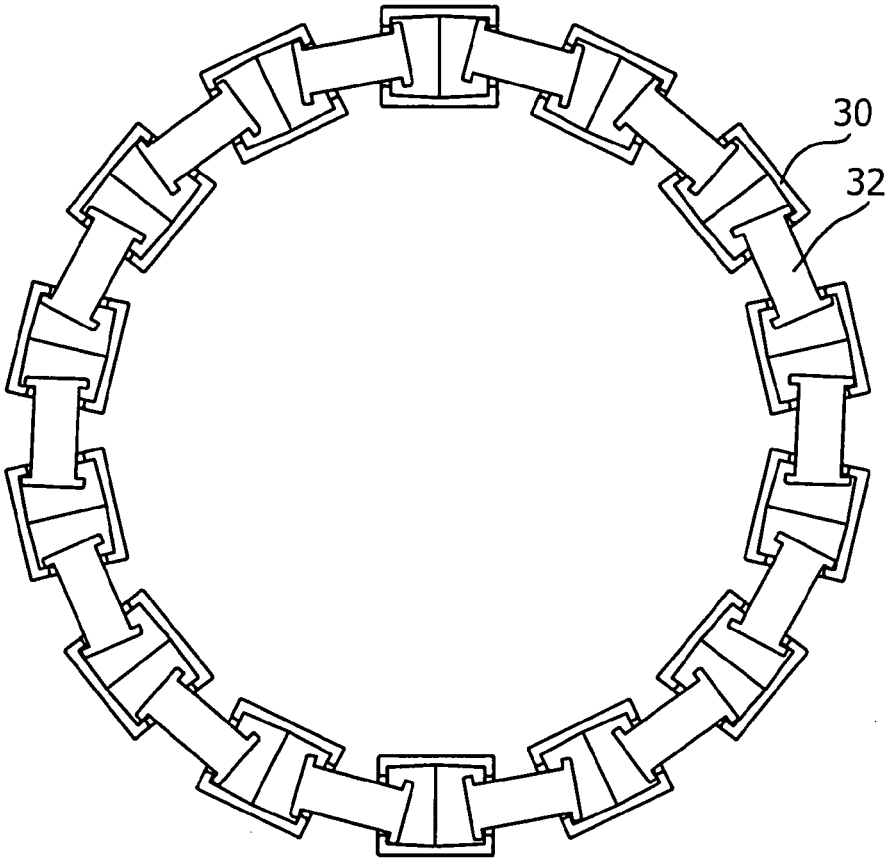
FIG. 7 shows an alternative embodiment of the invention.

In an alternative embodiment, the core elements may comprise alternating elements with two integrated female parts 30 and two integrated male parts 32 as shown in FIG. 7.

The invention claimed is:

1. A reinforcement ring, comprising an annular coil spring with a core unit arranged inside to prevent deforming or twisting of the ring under load, said core unit comprising a chain of interlinked elements.

2. The reinforcement ring of claim 1, wherein the interlinked elements comprise a male part and a female part being engagable with a corresponding female part, respectively a male part of an adjoining element.

3. The reinforcement ring of claim 2, wherein the interlinked elements have the shape of a stemmed glass, the opening of one element accommodating the foot of the adjoining element.

4. The reinforcement ring of claim 3, wherein the interlinked elements are manufactured with an enlarged free end of the cup shaped part of the elements.

5. The reinforcement ring of claim 3, wherein the end elements of the annular assembly of core elements have mating threads at the narrow end of one element and at the open end of the adjoining element, to close the annular chain by a bolt and nut-connection.

6. The reinforcement ring of claim 1, wherein that the core elements comprises sleeves with restricted open ends making a pair of female parts, and stems with end flanges, making pair of male parts, to be connected in an alternating sequence.

7. The reinforcement ring of claim 6, wherein the end elements of the annular assembly of core elements have mating threads at the narrow end of one element and at the open end of the adjoining element, to close the annular chain by a bolt and nut-connection.

* * * * *